US007451873B2

(12) United States Patent
Chow et al.

(10) Patent No.: US 7,451,873 B2
(45) Date of Patent: Nov. 18, 2008

(54) PACKAGING CARD FOR A SPOOLED MATERIAL

(75) Inventors: Ringo Chi Kit Chow, Toronto (CA); Ngai Wing Wong, Scarborough (CA)

(73) Assignee: Evergo Printing Co. Ltd., Scarborough, Ontario (CA)

( * ) Notice: Subject to any disclaimer, the term of this patent is extended or adjusted under 35 U.S.C. 154(b) by 455 days.

(21) Appl. No.: 10/899,274

(22) Filed: Jul. 26, 2004

(65) Prior Publication Data

US 2006/0016707 A1 Jan. 26, 2006

(51) Int. Cl.
*B65D 85/66* (2006.01)

(52) U.S. Cl. ..... 206/395; 206/389

(58) Field of Classification Search ..... 206/389, 206/395, 303, 446, 493, 495, 806; D9/722, D9/415; 15/104.002
See application file for complete search history.

(56) References Cited

U.S. PATENT DOCUMENTS 2,142,826 A * 1/1939 Rosello ..... 206/446
4,062,450 A * 12/1977 Carter ..... 206/485
4,706,804 A * 11/1987 Hall ..... 206/780
D295,833 S * 5/1988 Roth ..... D9/722
5,279,420 A * 1/1994 Rodgers ..... 206/446
5,697,502 A * 12/1997 Linz ..... 206/779
2006/0097119 A1 * 5/2006 Williamson et al. ..... 248/309.1

* cited by examiner

*Primary Examiner*—J. Gregory Pickett
(74) *Attorney, Agent, or Firm*—Fay Sharpe LLP

(57) ABSTRACT

A packaging card for holding a refill spool. The packaging card includes a hanger cut-out for hanging the refill spool on a display rack. The packaging card comprises a main panel, a bottom panel, a support panel and an end panel. The main panel is connected to the bottom panel by a hinged connection such as a crease line. The bottom panel and the support panel are connected by a crease line. The support panel is also connected to the end panel by a crease line. The end panel is affixed to a portion of the main panel using an adhesive, and the end panel and support panel form a buttress to support the bottom panel. The bottom panel provides a support platform for holding the spool. The crease lines between the end, support and bottom panels allow the packaging card to be folded flat, for example, for packing and shipping to the refill spool manufacturer.

8 Claims, 10 Drawing Sheets

PACKAGING CARD FOR A SPOOLED MATERIAL

FIELD OF THE INVENTION

This invention relates to a packaging apparatus, more particularly to a packaging card for holding a spool of material.

BACKGROUND OF THE INVENTION

Packaging cards are used in the lint adhesive roller industry to support a single refill packaging spool. When the user of a lint adhesive roller is finished with the present roll, the user replaces the roll with the refill spool. The refill spool requires a packaging card in order to be on display in a retail environment. The bottom of the packaging card supports the single refill from the bottom. The middle of the packaging card extends through the center of the refill spool. The top of the packaging card, or header panel, is used to hang the refill spool from a display hook.

A principle difficulty of prior art devices is that they cannot be transported in their assembled state from the packaging card manufacturer to the refill spool manufacturer. When prior devices are created by the packaging card manufacturer they are transported as an unassembled flat sheet. This is convenient for transportation because the cards can be stacked, thereby reducing the size of the shipping package. The refill spool manufacturer receives the unassembled cards, and proceeds to fold the device into the assembled state. The requirement for assembly involves another operation for the refill spool manufacturer who may not have the specialized equipment to fold the card, or may not want to endure the expense to manually fold the card.

Prior devices are also cumbersome to manufacture. Packaging cards must be folded in order to create a sufficiently strong support to hold a refill spool. Some prior packaging cards must be folded in more than one rotational direction, for instance both clockwise and counter-clockwise. It is difficult for a machine to rotate a card in more than one rotational direction.

Another difficulty is that prior devices require the use of slots and hooks in the packaging card to maintain the folds in place. This further complicates the assembly process whether manual or by machine.

Yet another difficulty involves the header panel. The header panel must be wider than the inner radius of the refill spool. The wider header panel prevents the packaging card from falling out of the refill spool. However, since the header panel is wider than the inner radius of the refill spool, prior manufacturing devices were required to fold two sides of the header panel in order to initially aggregate the packaging card with the refill spool, resulting in a finished product. It is cumbersome to those in the art to design a manufacturing device to fold two sides of the header panel.

Accordingly, there remains a need in the art for novel packaging cards that address at least some of the deficiencies of prior art devices.

BRIEF SUMMARY OF THE INVENTION

The present invention relates to a packaging card for supporting or holding a spool.

In a first aspect, the present invention provides a packaging card for a spool, the packaging card comprises: a main panel; a bottom panel having a hinged connection to an edge of the main panel; a support panel having a hinged connection to another edge of the bottom panel; an end panel having a hinged connection to an edge of the support panel; the end panel having a length sufficient to meet a face of the main panel with the bottom panel and the support panel and the end panel being hinged along the respective hinged connections; the face providing a surface for receiving an adhesive and the end panel being affixed to the main panel.

In another aspect, the present invention provides a blank for a packaging card, the blank comprises: a main panel; a bottom panel having a hinged connection to an edge of the main panel; a support panel having a hinged connection to another edge of the bottom panel; an end panel having a hinged connection to an edge of the support panel; the end panel having a length sufficient to meet a face of the main panel with the bottom panel and the support panel and the end panel being hinged along the respective hinged connections; the face providing a surface for receiving an adhesive for affixing the end panel to the main panel.

In another aspect, the present invention provides a method for assembling a packaging card for a spool, the packaging card comprises a blank having a main panel, a bottom panel having a hinged connection to an edge of the main panel, a support panel having a hinged connection to another edge of the bottom panel, an end panel having a hinged connection to an edge of the support panel, the end panel having a length sufficient to meet a face of the main panel, the method comprises the steps of: folding the bottom panel with respect to the main panel along the hinged connection; folding the support panel with respect to the bottom panel along the respective hinged connection: folding the end panel with respect to the support panel along the respective hinged connection; applying an adhesive to a portion of the end panel; affixing the end panel with the adhesive to the face of the main panel.

In another aspect, the present invention provides a packaging card for a spool, the packaging card comprises: a main panel; a support panel having a hinged connection to an edge of the main panel; a first bottom panel having a hinged connection to another edge of the support panel; a second bottom panel having a hinged connection to an edge the first bottom panel; the second bottom panel having a face for receiving an adhesive for affixing the second bottom panel to a face of the first bottom panel with the second bottom panel being folded along the hinged connection with the first bottom panel; the support panel having a face for receiving the adhesive for affixing the support panel to another face of the second bottom panel, the support panel being folded along the hinged connection with the first bottom panel.

In yet another aspect, the present invention provides a packaging card for a spool, the packaging card comprises: a main panel; a first support panel having a hinged connection to an edge of the main panel; a bottom panel having a hinged connection to another edge of the support panel; a second support panel having a hinged connection to an edge of the bottom panel; an end panel having a hinged connection to an edge of the second support panel; the end panel having a face for receiving an adhesive for affixing the end panel to a face of the main panel, the end panel being folded along the hinged connection with the second support panel, and the main panel being folded along the hinged connection with the first support panel.

Other aspects and features of the present invention will become apparent to those ordinarily skilled in the art upon review of the following description of specific embodiments of the invention in conjunction with the accompanying drawings.

BRIEF DESCRIPTION OF THE DRAWINGS

Reference is next made to the accompanying drawings, which show, by way of example, embodiments of the present invention and in which.

DETAILED DESCRIPTION OF THE PREFERRED EMBODIMENT

Figure 1:
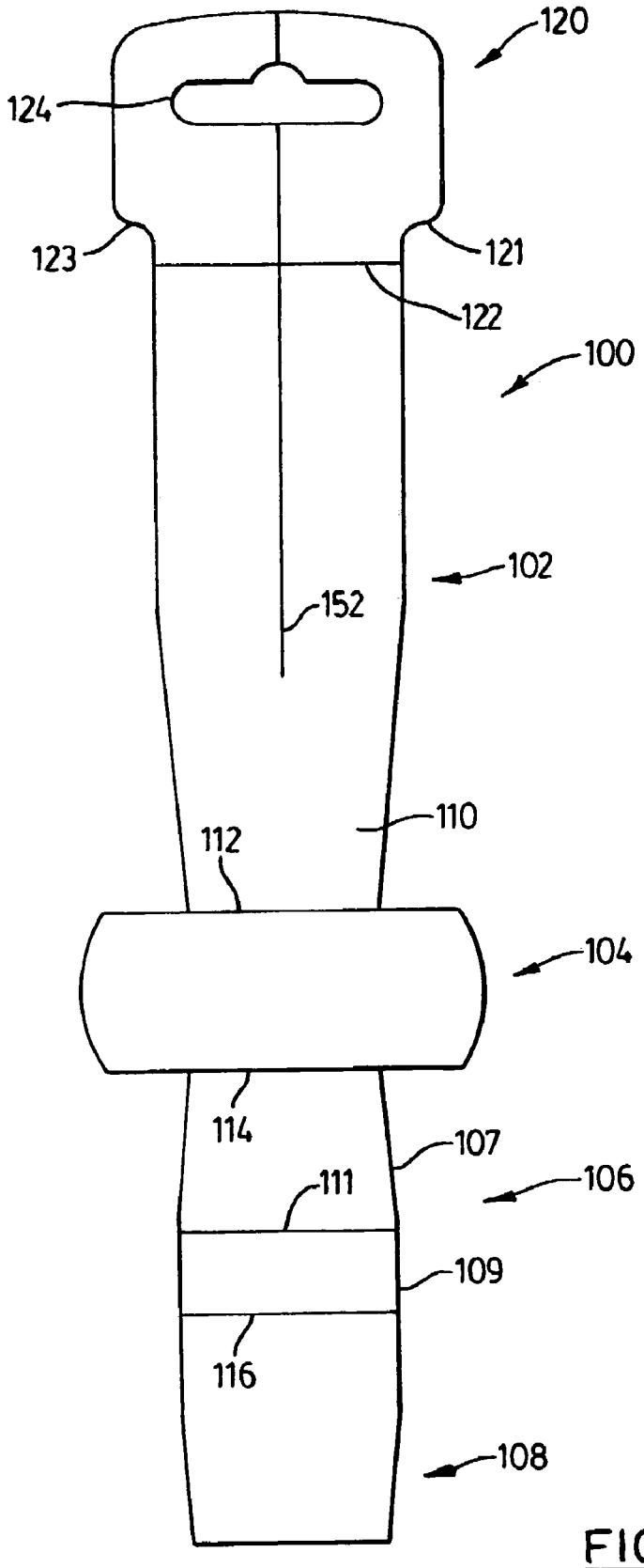
FIG. 1 is a front view of an embodiment of a packing card in accordance with the present invention.
Figure 2:
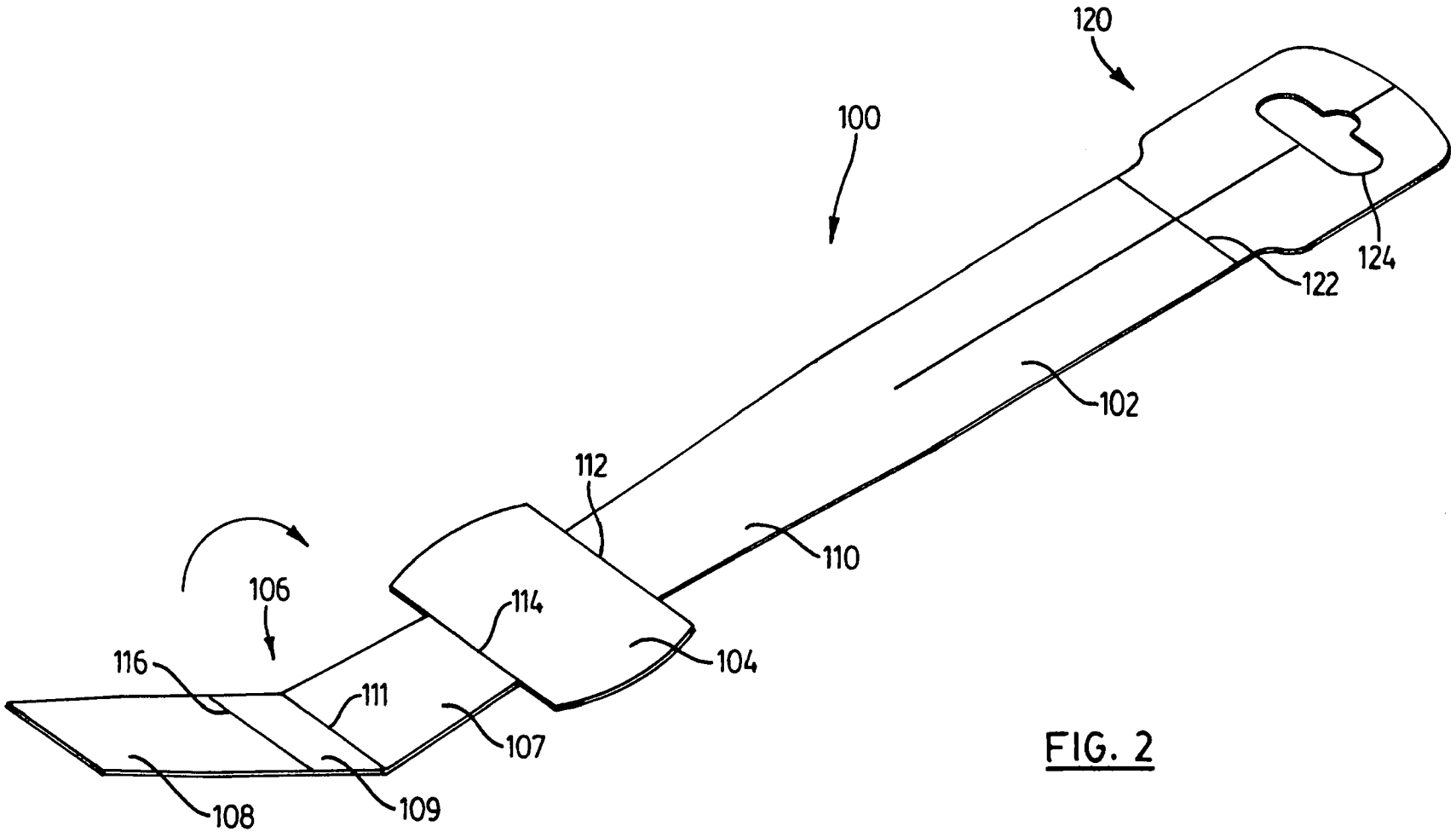
FIG. 2 is an isometric view of an assembly stage for the packaging card of FIG. 1.
Figure 10:
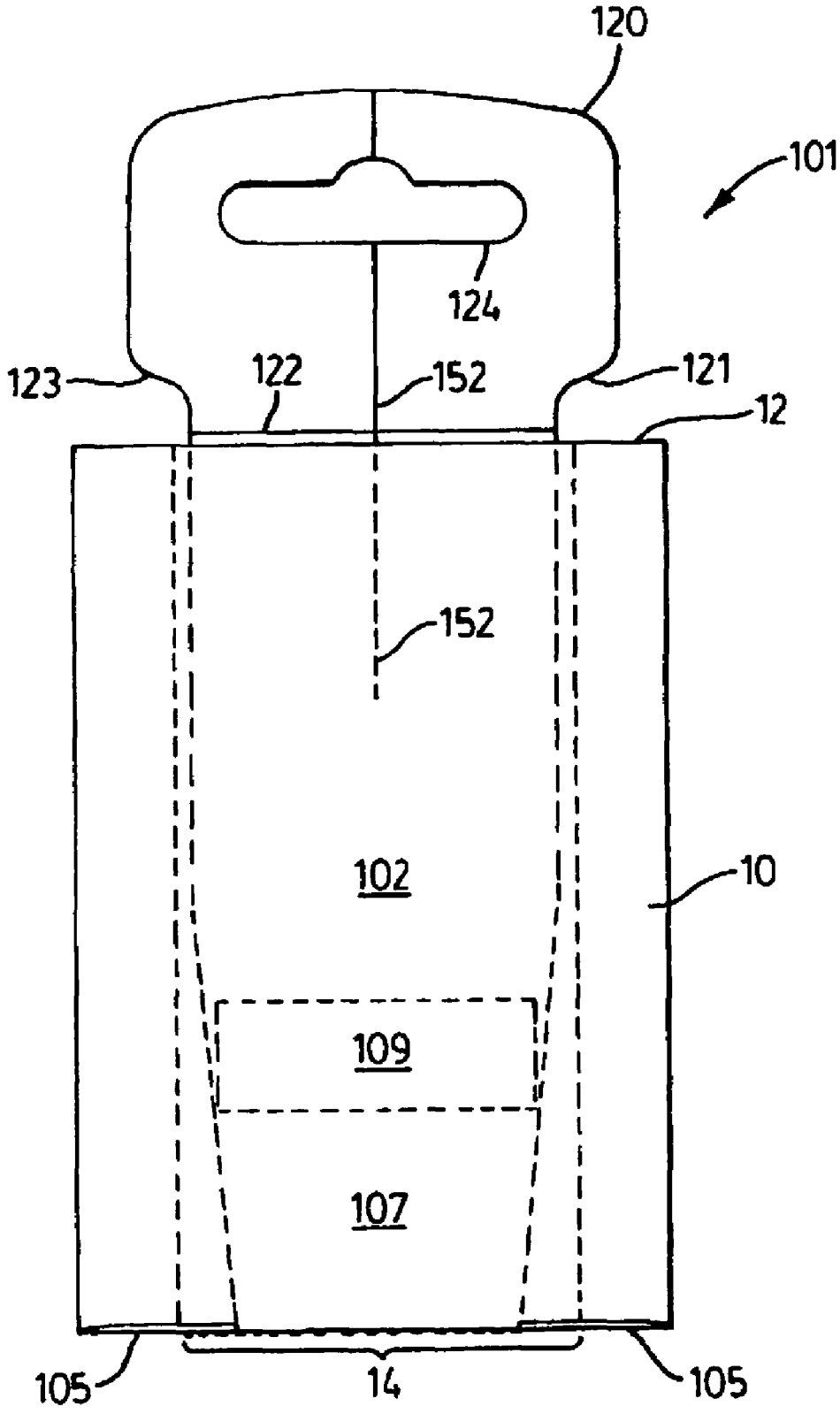
FIG. 10 is a front view of a packaging card according to the present invention holding a refill spool.

Reference is first made to FIG. 1 which shows a packaging card 100 for supporting a spool, for example a refill spool for a lint brush, according to one embodiment of the invention. As shown, the packaging card 100 comprises a main panel 102, a bottom support panel 104, a support flap 106 and an end flap 108. The main panel 102 is at least as long as the longitudinal length of a refill spool (FIG. 10). The main panel 102 includes a lower section 110 which is connected to the bottom support panel 104 by a hinged connection formed by a crease 112. Similarly, the bottom support panel 104 is connected to the support flap 106 by a hinged connection formed by a crease 114. The support flap 106 is connected to the end flap 108 by a hinged connection formed by a crease 116. The bottom support panel 104 has a width which is wider than the inner radius of the refill spool.

In the figures, like references indicate like components or elements.

As shown in FIG. 1, the main panel 102 includes a header section 120. The header section 120 is connected to the top portion of the main panel at a crease line 122. The crease line 122 permits the header 120 to be folded. The header 120 includes a hanger-holder cut-out 124.

As shown in FIG. 1, the support flap 106 comprises two sections indicated by references 107 and 109, respectively. The first section 107 is connected to the bottom support panel 104 along crease line 114, and the second section 109 is connected to the end flap 108 along crease line 116 as described above. The first section 107 is connected to the second section 109 by a hinged connection formed by a crease 111.

Figure 4:
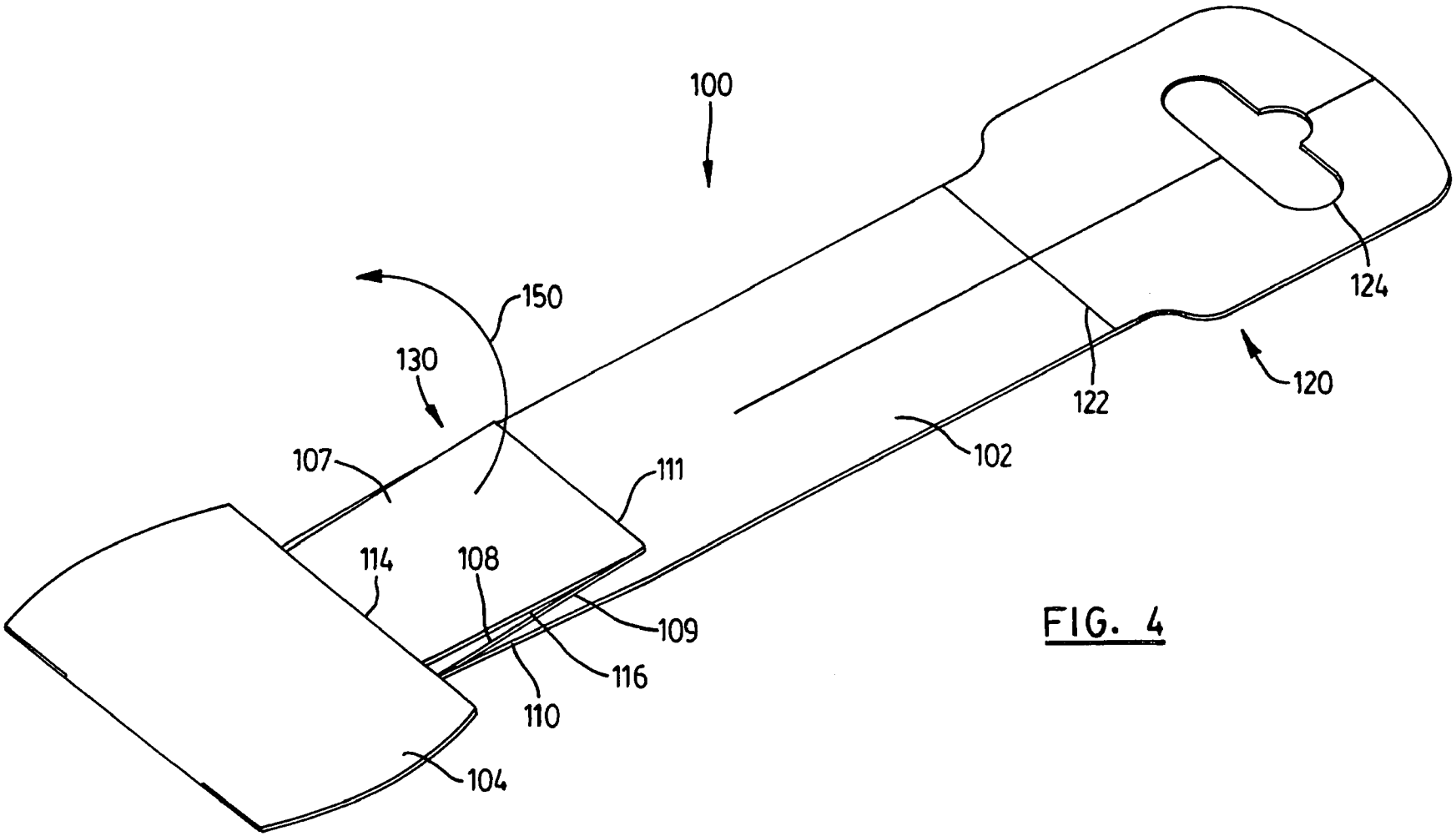
FIG. 4 is an isometric view of the assembled packaging card of FIG. 1.
Figure 5:
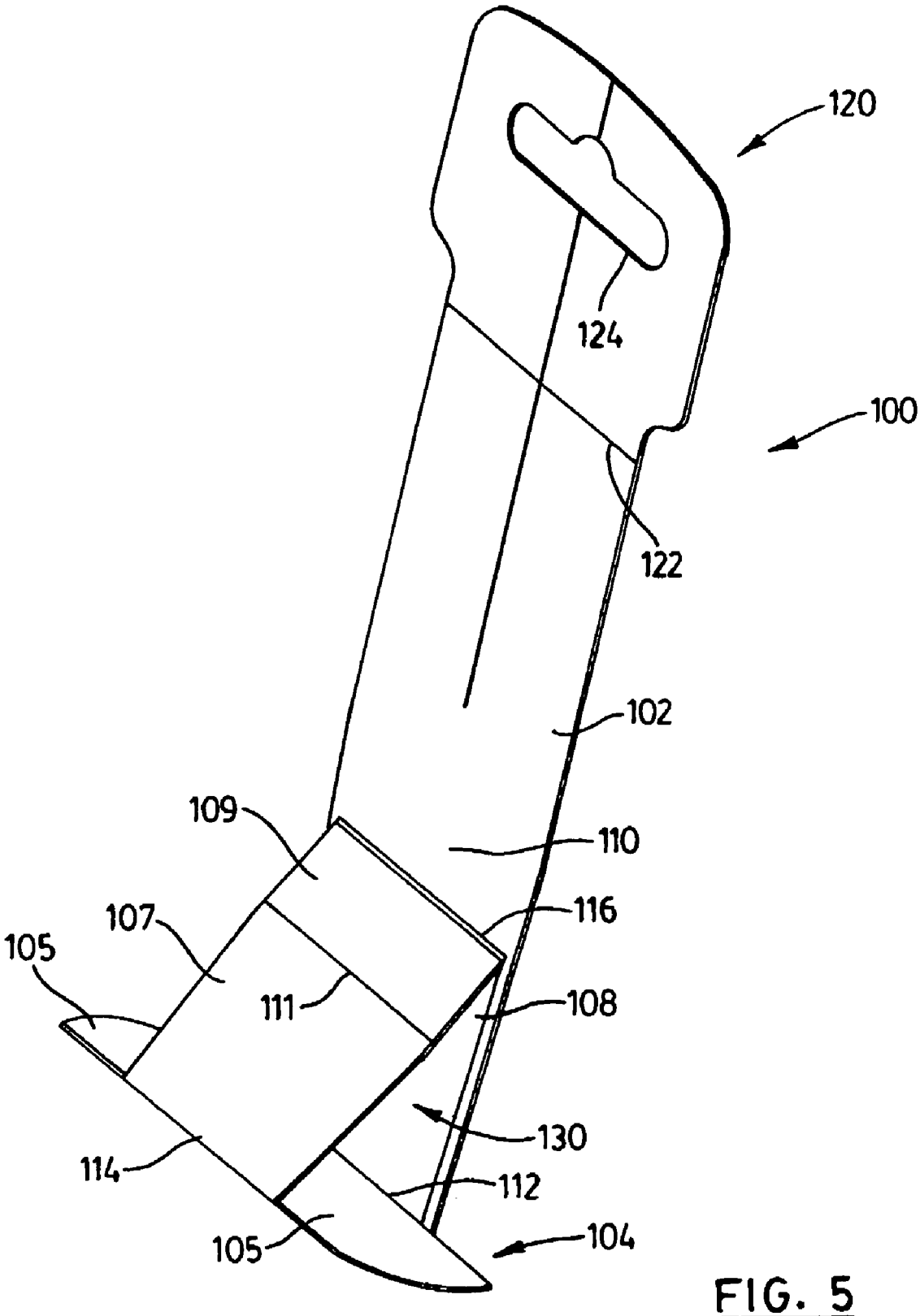
FIG. 5 is an isometric view of the assembled packaging card in display form.

As will now be described in more detail, the end flap 108 together with the support flap 106 form a buttress 130 as shown in FIGS. 4 and 5. The end flap 108 is affixed to the lower section 110 of the main panel 102 to secure the buttress 130 (FIG. 5). When affixed to the lower section 110, the buttress 130 supports the bottom support panel 104 so that the bottom support panel 104 is able to bear the weight of a refill spool, for example, when the packaging card 100 is hung from a hook on a display rack (not shown). As shown in FIG. 5, in the open or unfolded position, the buttress 130 comprises a generally polyhedral shape with the bottom support panel 104.

Referring again to FIG. 1, the two creases 111 and 116 in the support flap 106 allow the buttress 130 to be folded flat after the end flap 108 is affixed (e.g. glued) to the lower section 110 of the main panel 102 during fabrication or assembly. The capability to fold the packaging card 100 flat after assembly facilitates packing and shipping to the end user, e.g. refill spool manufacturer or supplier. In addition, the end user is not required to perform any further assembly steps. The folded packaging card 100 (FIG. 4) is simply unfolded (as shown in FIG. 5) and inserted into the refill spool 10 as shown in FIG. 10. As will be described in more detail below, insertion of the packaging card 100 may require bending of the header 120 depending on the design of the header 120.

Reference is next made to FIGS. 2, 3, 4, and 5 which illustrate the assembly of the packaging card 100 and the folding/unfolding of the assembled packaging card 100.

Figure 3:
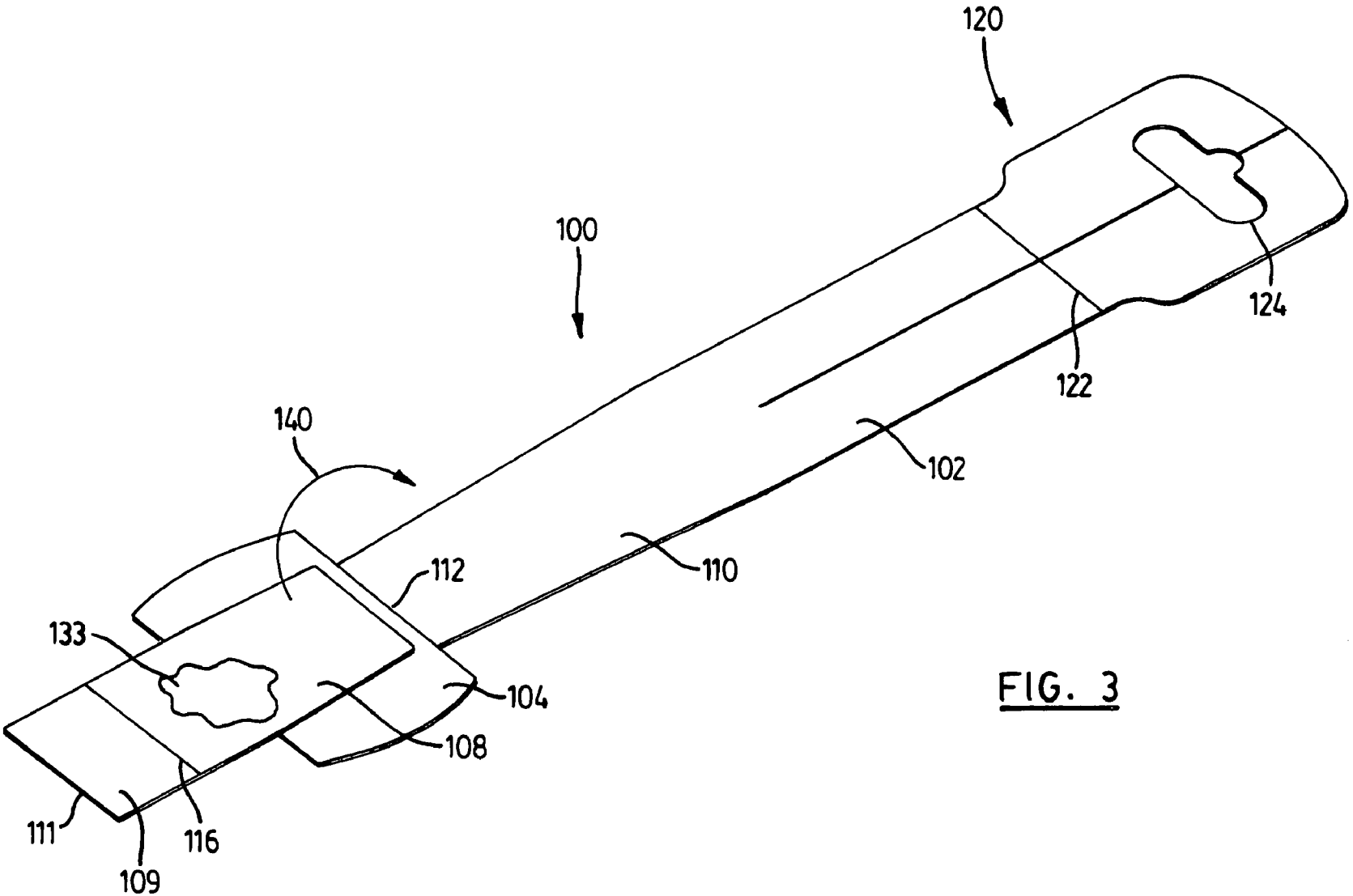
FIG. 3 is an isometric view of another assembly stage for the packaging card of FIG. 1.

As shown in FIG. 3, the end flap 108 and second section 109 of the support flap 106 are folded over at the crease 111. An adhesive or glue 133 is applied to the surface of the end flap 108, and the end flap 108 and section 109 are folded over in the direction of arrow 140 and pressed against the lower section 110 of the main panel 102 as shown in FIG. 4. Once the end flap 108 is affixed to the lower section 110 of the main panel 102, the assembled packaging card 100 is placed into the unfolded or ready to use position by unfolding or folding back the first section 107 of the support flap 106 in the direction indicated by arrow 150 in FIG. 4. The unfolded or ready to use position of the packaging card 100 is shown in FIG. 5. As shown, the first section 107 and the second section 109 of the support flap 106 form the buttress 130 which supports the bottom support panel 104. Holding strength for the buttress 130 is derived from flap and glued together surfaces of the lower section 110 and the end flap 108. As shown in FIG. 5 and FIG. 10, the end portions (indicated by reference 105) provide a support platform to hold each side of the refill spool 10.

Referring back to FIG. 1, the header panel 120 may include side tabs 121 and 123. The side tabs 121, 123 increase the width of the header panel 120 and prevent the packaging card 100 from falling out of the refill spool 10 (FIG. 10). The crease line 122 (i.e. top crease) allows the packaged spool (indicated by reference 101 in FIG. 10) (i.e., the packaging card 100 and refill spool 10 as shown in FIG. 10) to be transported easily. The top crease 122 allows the header panel 120 to be folded such that one face of the header panel 120 meets the top surface 12 (FIG. 10) of the refill spool 10 (FIG. 10). The packaged spool 101 can be stacked on top of one another without the header panel 120 obstructing the stack. The hanger-hold 124 allows the packaged spool 101 to hang from a display hook. The header panel 120 may also be printed to advertise the name, origin, contact numbers, and any information pertaining to the refill spool 10.

Referring to FIG. 1, the header panel 120 may include a longitudinal crease indicated by reference 152. The longitudinal crease 152 runs in the longitudinal direction of the header panel 120 and can extend into at least a portion of the main panel 102, as shown in FIG. 1. The longitudinal crease 152 is located approximately along the longitudinal axis of header panel 120 and the main panel 102. The longitudinal crease 152 facilitates insertion of the packaging card 100 into the refill spool 10. In particular, the packaging card 100 is folded to decrease the effective width of the header panel 120 and the main panel 102 and allow the card 100 to be inserted through the open center 14 (FIG. 10) of the refill spool 10 (FIG. 10). Once the side tabs 121 and 123 clear the refill spool 10, the header panel 120 and the main panel 102 unfold to an open or relatively flat position and the refill spool 10 is secured at one end by the bottom support panel 104 and at the other end by the side tabs 121 and 123 in the header panel 120. It will be appreciated that a design choice may involve omitting the side tabs 121, 123 on the header panel 120. Since the header panel 120 can be sized to the open center 14 of the refill spool 10 (FIG. 10), the longitudinal crease 152 may be omitted in this variant.

Referring again to FIG. 1, the creases 111, 112, 114, 116, and 122 may comprise a standard crease or a false crease. A standard crease comprises indenting the packaging card 100 material along a line. A standard crease retains the memory of the packaging card 100 material and may unfold easily. A false crease, on the other hand, comprises a combination of creases and/or perforations made along a same line. The perforations make a false crease easier to fold and the false crease will maintain a fold better than a standard crease. For the packaging card 100, the top crease 122 and the longitudinal crease 152 comprises standard creases and not false creases, so that the memory of the material of the packaging card 100 allows the top crease 122 and longitudinal crease 152 to easily unfold to their original flat state, i.e., after the packaging card 100 is inserted into the open center 14 of the refill spool 10 (FIG. 10).

Referring back to FIG. 3, it will be appreciated that the fold of the end flap 108 and the second section 109 along the crease line 111 is in the same direction as the second fold of the first section 107 of the support flap 106 along the crease line 114. This means that both folding operations can be performed without flipping the packaging card 100, and as a result the packaging card 100 lends itself to automated fabrication and assembly techniques.

Suitable material for fabricating the packaging card 100 include solid bleached sulphite (SBS) coated two-sided cardboard. Desirable properties of suitable materials include sufficient strength to support the refill spool, while having soft and/or long fibres for creasing and folding without cracking. The cost of the material is also a consideration. Suitable adhesives and glues for use with SBS coated cardboard include Supergrip 1103 V 4 Pink or any other copolymer emulsion base.

Figure 6:
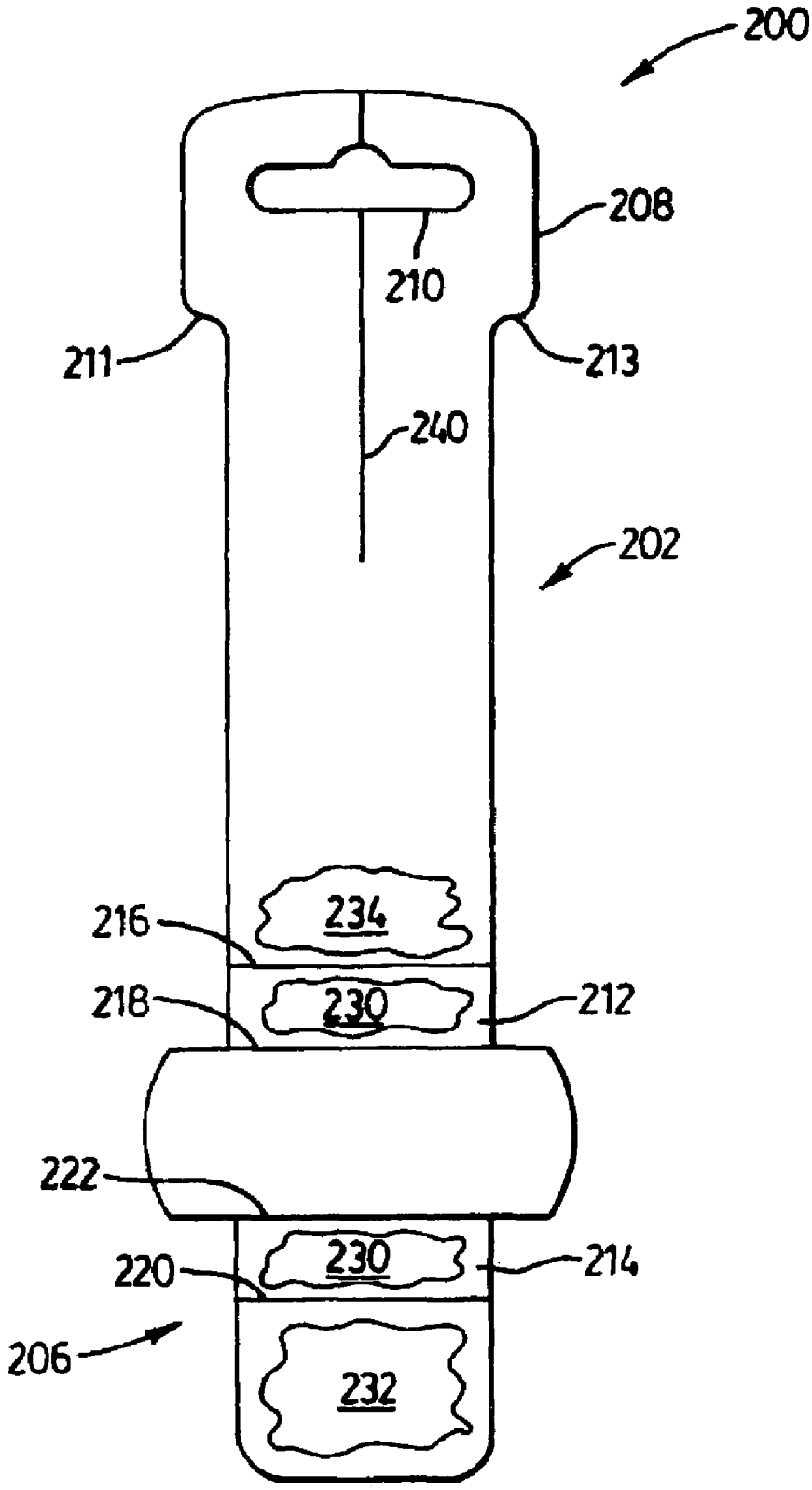
FIG. 6 is a front view of another embodiment of a packaging card in accordance with the present invention.
Figure 7:
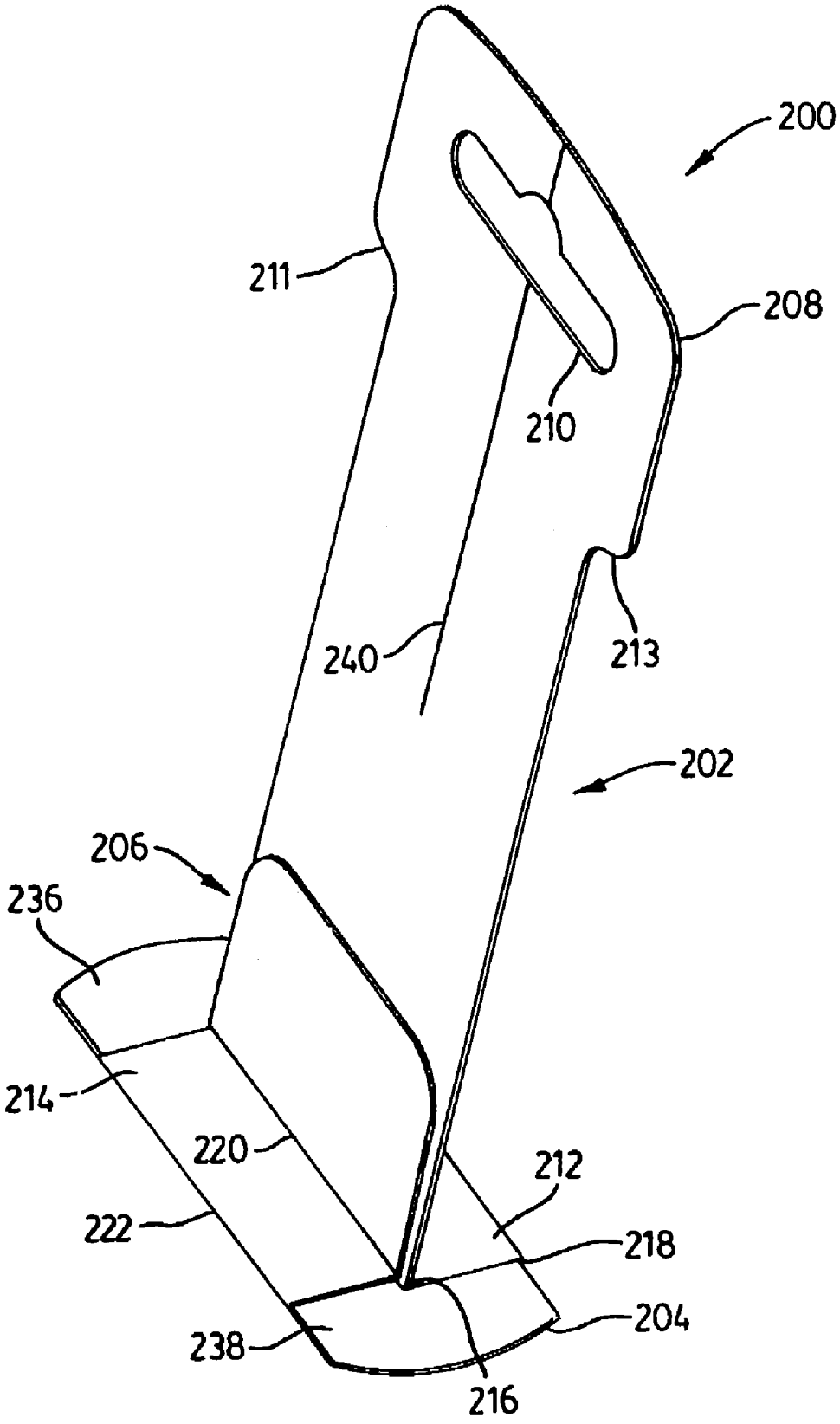
FIG. 7 is an isometric view of the packaging card of FIG. 6 in assembled and in display form.

Reference is next made to FIGS. 6 and 7, which show another embodiment of a packaging card 200 according to the present invention. As shown in FIG. 6, the packaging card 200 comprises a main panel 202, a bottom support panel 204, and a support panel 206. The main panel 202 also includes a header panel 208 with a hanger cut-out 210. As shown, the main panel 202 includes a support flap 212. The support panel 206 also includes a support flap 214. The support flap 212 includes a crease line 216 on the main panel 202 and is connected to the bottom support panel 204 by another crease line 218. The support flap 214 includes a crease line 220 in the support panel 206 and is connected to the bottom support panel 204 by a crease line 222.

The packaging card 200 is assembled as shown in FIG. 7. In its assembled form, the main panel 202 is folded along the crease lines 216 and 218, and an adhesive or glue 230 may be applied to a surface of the support flap 212 (FIG. 6) to affix the support flap 212 to the top surface of the bottom support panel 204. Similarly, the support panel 206 is folded along crease lines 220 and 222. The support flap 214 may be affixed to the top surface of the bottom support panel 204 by applying the adhesive or glue 230 to the top surface of the flap 214 as shown in FIG. 6. The support panel 206 is affixed to the lower portion of the main panel 202 (as shown in FIG. 7) with the application of glue to a portion 232 of the support panel 206 and/or a lower portion 234 of the main panel 202 as shown in FIG. 6. In the assembled position shown in FIG. 7, the end portions of the bottom support panel 204 provide support panels 236 and 238 for supporting the refill spool 10 in a similar fashion as described above for packaging card 100 of FIGS. 1 to 5. For packaging, the bottom support panel 204 is folded relatively flat at crease 220.

The packaging card 200 may include side tabs 211 and 213 on the header panel 208 as described above for the packaging card 100. Similarly, the packaging card 200 may include a longitudinal crease 240 as described above.

Figure 8:
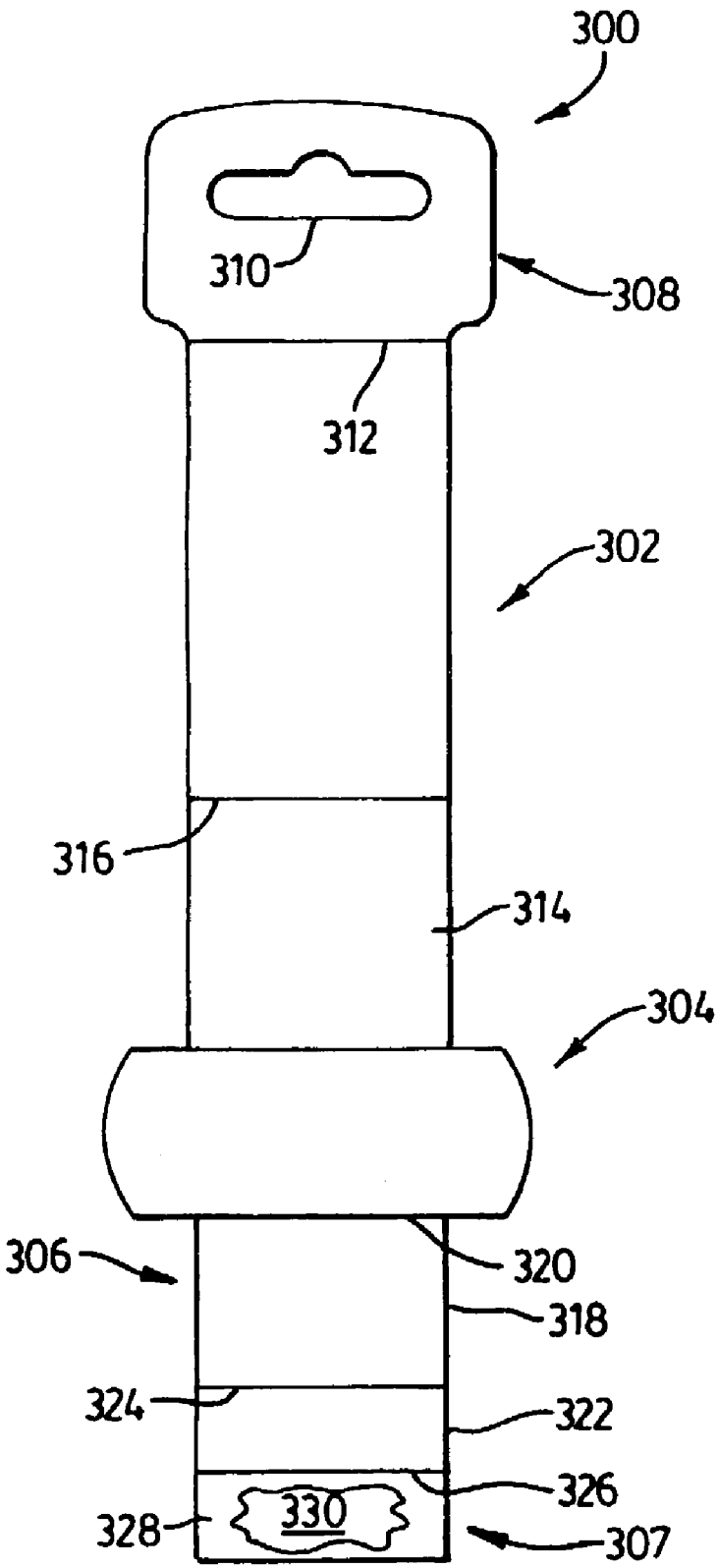
FIG. 8 is a front view of a packaging card according to a third embodiment of the present invention.

Reference is next made to FIG. 8 which shows another embodiment of a packaging card 300 according to the present invention. The packaging card 300 comprises a main panel 302, a bottom support panel 304, a support panel 306 and an end panel 307. The main panel 302 includes a header panel 308. The header panel 308 includes a hanger cut-out 310 and may be connected to the main panel 302 by a crease 312. The main panel 302 includes a support flap 314 with a crease 316 in the main panel 302. The support panel 306 comprises a first section 318 connected to the bottom support panel 304 at a crease 320, and a second section 322 connected to the first section 318 by a crease 324. The end panel 307 is connected to the second section 322 on the support panel 306 at a crease 326.

To assemble the packaging card 300 of FIG. 8, an adhesive or glue 330 is applied to a portion 328 of the end panel 307. The glued face of the end panel 307 is then affixed to the support flap 314 of the main panel 302.

Figure 9:
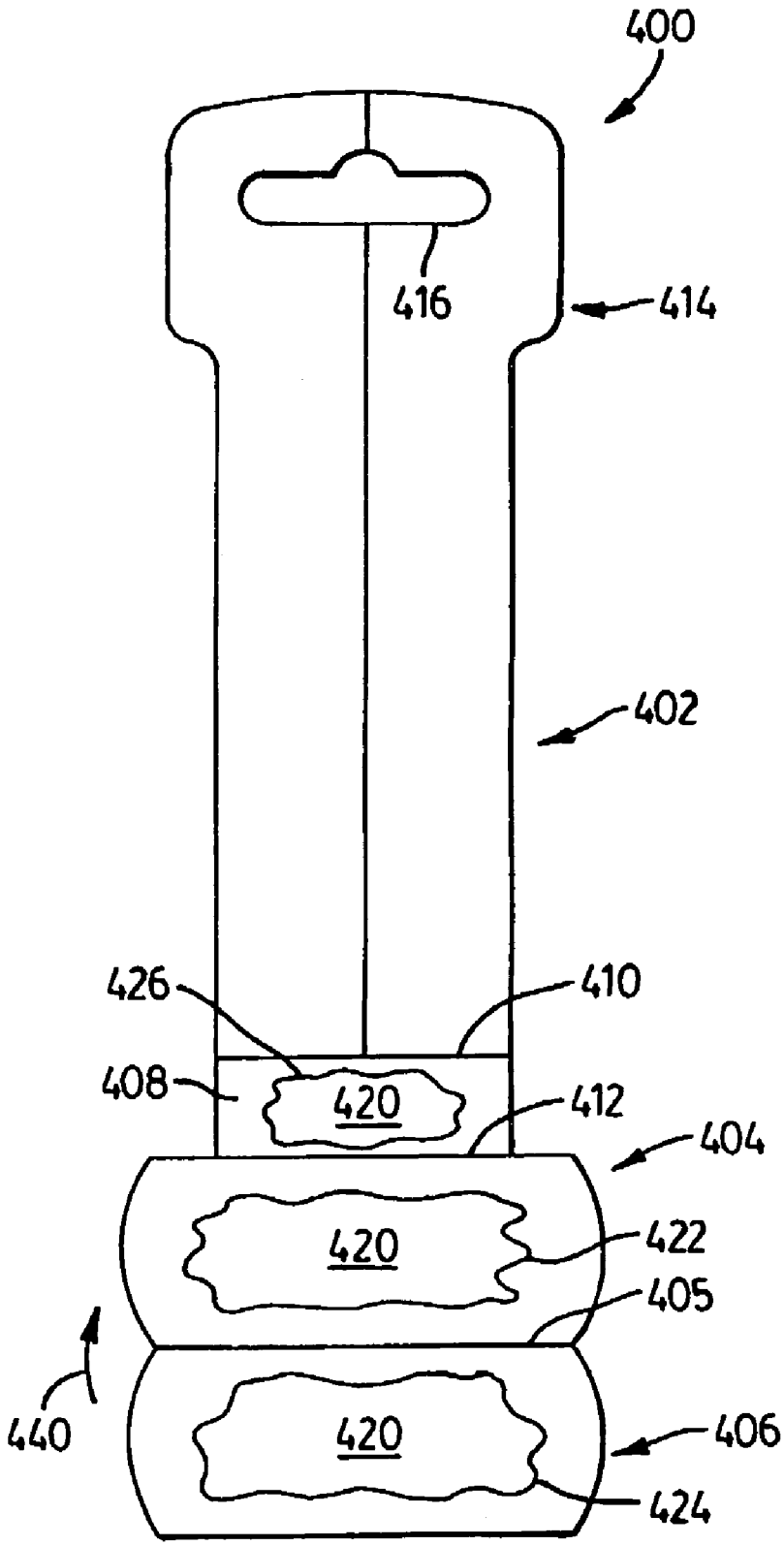
FIG. 9 is a front view of a packaging card according to a fourth embodiment of the present invention.

Reference is next made to FIG. 9, which shows another embodiment of a packaging card 400 according to the present invention. The packaging card 400 comprises a main panel 402, a first bottom support panel 404, and a second bottom support panel 406. The main panel 402 includes a support flap 408 with a crease 410 in the main panel 402. The support flap 408 is connected to the first bottom support panel 404 by a crease 412. The first 404 and the second 406 bottom support panels are connected at a crease 405.

To assemble the packaging card 400 of FIG. 9, an adhesive or glue 420 is applied to a portion 422 of the first bottom support panel 404 and/or to a portion 424 of the second bottom support panel 406. The second bottom support panel 406 is folded over, i.e., in the direction of arrow 440, at the crease line 405 and affixed to the first bottom support panel 404. The glue 420 is applied to a portion 426 of the support flap 408 on the main panel 402, and the support flap 408 is folded over at the crease line 412 and affixed to the folded over second bottom support panel 404. The main panel 402 is then folded into an upright position at the crease line 410.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A packaging card for a spool, said packaging card comprising:

a main panel having a first width and being adapted to extend through the spool;

a bottom panel having a hinged connection to an edge of said main panel, the bottom panel having a second width larger than the first width such that the bottom panel is adapted to support the spool;

a support panel having a hinged connection to another edge of said bottom panel;

an end panel having a hinged connection to an edge of said support panel;

said end panel having a length sufficient to meet a face of said main panel with said bottom panel and said support panel and said end panel being hinged along said respective hinged connections;

said face providing a surface for receiving an adhesive and said end panel being affixed to said main panel.

2. The packaging card as claimed in claim 1, wherein said support panel comprises a first section and a second section, said first and said section being connected by a hinged connection.

3. The packaging card as claimed in claim 2, wherein said bottom panel is pivoted with respect to said main panel and said first and said second sections are pivoted with respect to each other, for folding said packaging card flat.

4. The packaging card as claimed in claim 1, wherein said hinged support panel and said end panel affixed to said main panel form a buttress for supporting said bottom panel in a bearing position for holding the spool.

5. The packaging card as claimed in claim 3, further including a header panel, said header panel being connected to said main panel at an end opposite to the hinged connection for said bottom panel.

6. The packaging card as claimed in claim 5, wherein said header panel includes a cut-out for receiving a hook for hanging said packaging card with the spool on a display rack.

7. The packaging card as claimed in claim 6, wherein said header panel includes one or more side tabs for locking the spool.

8. The packaging card as claimed in claim 7, wherein said header panel includes a fold line for partially folding said header panel for insertion into the spool.

* * * * *